US007418232B2

(12) United States Patent
Tabuchi et al.

(10) Patent No.: US 7,418,232 B2
(45) Date of Patent: Aug. 26, 2008

(54) ORIGINAL DOCUMENT SUPPLY DEVICE FOR IMAGE FORMING DEVICE, AND IMAGE FORMING DEVICE EQUIPPED WITH THE SAME

(75) Inventors: Hidehiro Tabuchi, Osaka (JP); Toshihide Higashimori, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 328 days.

(21) Appl. No.: 11/258,073

(22) Filed: Oct. 26, 2005

(65) Prior Publication Data

US 2007/0092319 A1 Apr. 26, 2007

(51) Int. Cl.
*G03G 15/00* (2006.01)

(52)
U.S. Cl. ..... 399/367; 399/368; 399/369; 399/370; 399/371; 399/372; 399/373; 399/374; 399/375; 399/393; 400/624

(58) Field of Classification Search ..... 399/368, 399/369, 370, 371, 372, 373, 375, 393; 400/624
See application file for complete search history.

(56) References Cited

U.S. PATENT DOCUMENTS 4,715,595 A * 12/1987 Ishigaki ..... 271/110
2004/0240916 A1* 12/2004 Takata et al. ..... 399/367

* cited by examiner

*Primary Examiner*—Ren Yan
*Assistant Examiner*—Andy L Pham
(74) *Attorney, Agent, or Firm*—Global IP Counselors, LLP

(57) ABSTRACT

The ADF 11 is a device for feeding an original document toward an original document scanning position R, comprising an original document loading unit 31, paper feeding roller 51, pressure sensor 33 and lift plate drive unit 35. The original document loading unit 31 comprises a lift plate 41 allowing an original document to be loaded and vertically movable in an original document loading direction. The paper feeding roller 51 is disposed above the lift plate 41 disposed at the lowermost position with an interval therebetween, and is capable of moving upwardly in coordination with a force received from below from the lift plate 41. The pressure sensor 33 is capable of detecting upward pressure on the paper feeding roller 51. The lift plate drive unit 35 causes the lift plate 41 to be lowered upon detection of upward pressure on the paper feeding roller 51.

3 Claims, 4 Drawing Sheets

ORIGINAL DOCUMENT SUPPLY DEVICE FOR IMAGE FORMING DEVICE, AND IMAGE FORMING DEVICE EQUIPPED WITH THE SAME

FIELD OF THE INVENTION

The present invention relates to an original document supply device for an image forming device and an image forming device equipped with the same.

FIELD OF THE INVENTION

Recently, it is becoming standard for an image forming device having a photocopy function to comprise an auto document feeder ("ADF") for feeding an original document to an original document scanning position. The ADF is disposed so as to face an original document scanning unit provided on top of a main unit, comprises an original document loading unit, and feeds original documents loaded on the original document loading unit one by one to the original document scanning position of the original document scanning unit.

A conventional ADF has been proposed comprising a lift plate onto which an original document is to be set and which is capable of moving vertically in the document loading direction. Normally, a lift plate may stand by at a lower position when no original document has been set, and at an upper position at which an edge of an original document is in direct contact with a paper feeding roller when such original document is set.

One such type of ADF is known wherein a lift plate is lifted after press of a main unit start button for giving instruction for scanning of the original document. However, because the lift plate lift after press of the start button, time is required before printing starts.

Thus, a conventional ADF has been proposed wherein upon loading of an original document, a lift plate immediately rises to stand by for a printing operation. In this case, upon press of a start button, scanning of an original document immediately starts.

However, because a conventional ADF is in such a state that the edge of an original document is in direct contact with a paper feeding roller with no gap therebetween, reset of an already set original document or subsequently loading additional original documents becomes difficult.

It is an object of the present invention to provide an image forming device capable of shortening the time from printing instruction to printing operation, thereby facilitating addition and reset of original documents.

SUMMARY OF THE INVENTION

The original document supply device according to a first aspect is an original document supply device for an image forming device for feeding an original document toward an original document scanning position, comprising an original document loading unit, paper feeding unit, detection means and lift plate drive unit. The original document loading unit comprises a lift plate allowing an original document to be loaded thereupon and capable of moving vertically in the original document loading direction. The paper feeding unit is disposed above the lift plate disposed at the lowermost position with an interval therebetween, and is capable of moving upwardly in response to a force received from below from the lift plate. Detection means is capable of detecting upward pressure on the paper feeding unit. The lift plate drive unit causes the lift plate to lower upon detection of upward pressure on the paper feeding unit.

With this device, when the lift plate is lifted in a state where an original document is set, a state is achieved such that the lift plate is in direct contact with the paper feeding unit via the original document or a state where the paper feeding unit has been pushed up (paper feeding state), and in such state no gap exists between the original document and paper feeding unit. In this state, when a user, wishing to add an original document, inserts another original document between the already set original document and lift plate, the paper feeding unit is pushed up. When this is detected, the lift plate is lowered. Thus a space is created between the original document and paper feeding unit, facilitating addition and reset of an original document.

Therefore, time from printing instruction to printing start is shortened, and at the same time, addition and reset of an original document can be made as necessary.

With the present invention, movement of the lift plate is not limited to movement parallel to the loading direction. For example, such movement includes vertical movement of the front end side in a case where the lift plate is in a rotatable state with the lift plate rear end (transport direction upstream side) as support point. Therefore, upper or lower includes not only the vertical direction but also a diagonal direction in a case where a position is upper or lower with respect to a reference position. Further, a force on the paper feeding unit includes, for example, pressure on the paper feeding unit.

The original document supply device according to a second aspect is the device of the first aspect, wherein detection means is a pressure sensor capable of detecting upward pressure on the paper feeding unit.

With this device, specifically, pressure exerted on the paper feeding unit is detected by the pressure sensor, thereby lowering the lift plate.

The original document supply device according to a third aspect is the device of second aspect, wherein the pressure sensor is capable of detecting degree of pressure. The lift plate drive unit causes the lift plate to be lowered only to an extent corresponding to the degree of pressure detected by the pressure sensor.

Adding a thick original document having many pages requires a considerably large space between the lift plate and paper feeding unit. When such an original document is added, a large pressure acts on the paper feeding unit. Therefore, this device is configured so that the extent to which the lift plate is lowered changes in accordance with the degree of pressure, thereby creating a suitable space between the lift plate and paper feeding unit.

The original document supply device according to a fourth aspect is the device of first aspect, wherein if after a force upwardly exerted on the lift plate has been detected, a predetermined amount of time passing without detection of further force upwardly exerted on the lift plate, the lift plate drive unit causes the lift plate to lift.

This device is configured so that the lowered lift plate is lifted when no addition of an original document is made or no force on the paper feeding unit is detected for a predetermined time, thereby basically achieving a paper feeding state.

The image forming device according to a fifth aspect comprises an original document supply device of the image forming device of the first aspect, and a main unit comprising an original document scanning unit and image forming unit. The original document scanning unit is disposed so as to face the original document supply device and is for scanning image information of an original document. The image forming unit forms an image according to the image information scanned by the original document scanning unit.

Because this image forming device comprises the original document supply device, the time from giving instruction for printing until actually starting printing is shortened, and when necessary, addition and reset of an original document is possible.

The present invention shortens the time from printing instruction to printing start, and at the same time allows addition and reset of an original document as necessary.

DETAILED DESCRIPTION OF THE PREFERRED EMBODIMENTS

[The Overall Constitution of an Image Forming Device]

Figure 1:
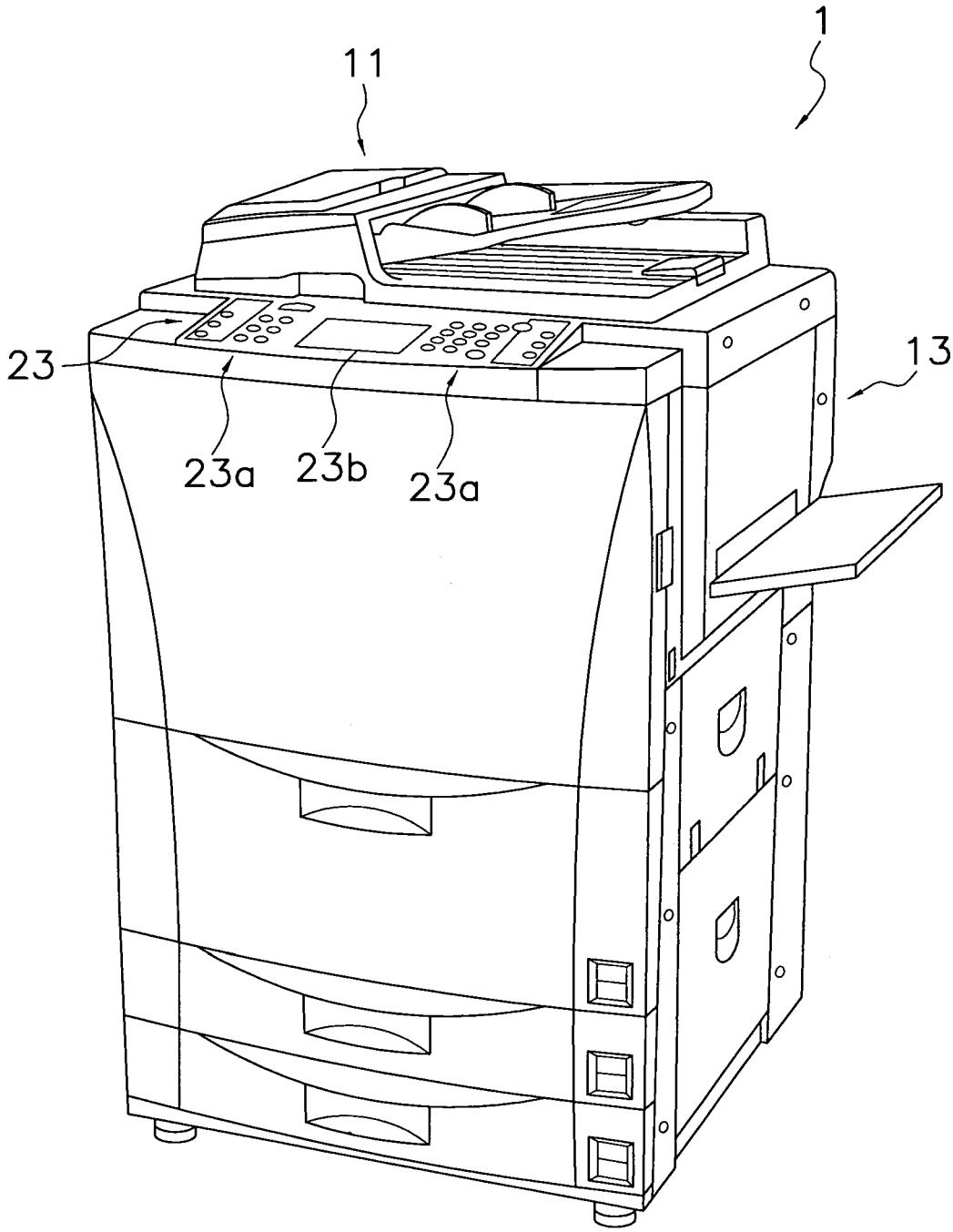
FIG. 1 illustrates an image forming device employing an embodiment of the present invention.
Figure 2:
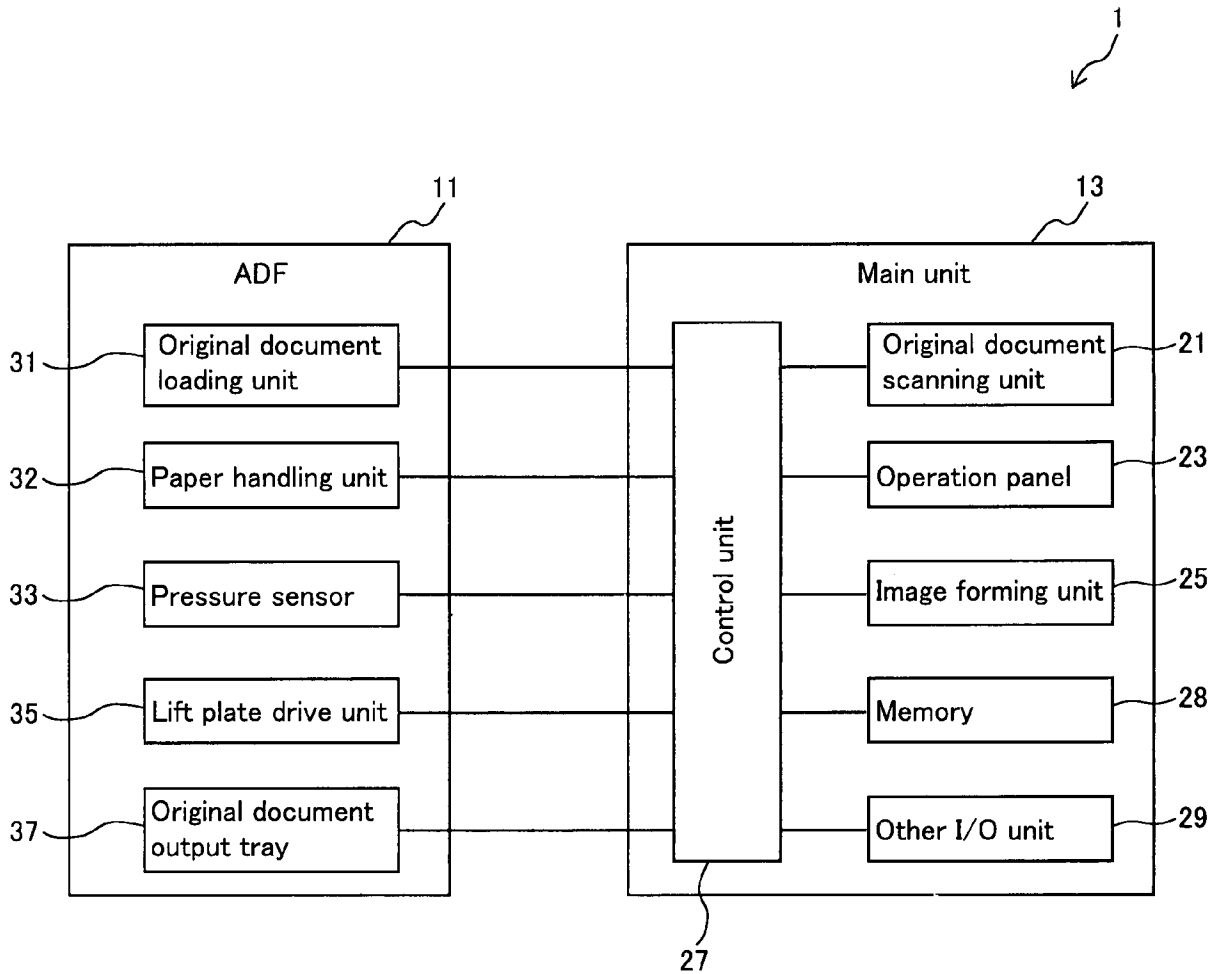
FIG. 2 is a block diagram showing the constitution of an image forming device.

FIGS. 1 and 2 illustrate an image forming device 1 employing an embodiment of the present invention.

The image forming device 1 is a multifunction machine functioning as a photocopier, printer, facsimile and scanner, comprising a main unit 13 and ADF 11.

The main unit 13 has an original document scanning unit 21, operation panel 23, image forming unit 25, control unit 27, memory 28 and other I/O unit 29.

The original document scanning unit 21 is for scanning an image of an original document on an original document table (not shown in the drawings) and is provided on top of the main unit 13 so as to face the ADF 11.

The operation panel 23 has a plurality of operation keys 23*a* and a display unit 23*b* comprising a touch panel liquid crystal display. The plurality of operation keys 23*a* comprise a start key for giving instruction for printing, numeric keypad for inputting numbers, and the like.

The image forming unit 25 forms an image according to image information scanned by the original document scanning unit 21, and comprises a photosensitive drum, disposed on the periphery thereof, a charging device, exposure device, development device and transfer device, and a fixing device disposed on the downstream side thereof (none of the foregoing is shown in the drawings).

The control unit 27 is constituted by a microcomputer comprising a CPU and the like, and controls the ADF 11, original document scanning unit 21 and other I/O unit. Further, the control unit 27 has a timer function and counts a predetermined length of time (described below).

The memory 28 constitutes a RAM and ROM and has stored therein various control programs to be executed by the control unit 27.

Also, the main unit 13 further comprises, as the other I/O unit 29, a communication unit for communicating with an external connection device such as a personal computer, facsimile and the like, paper feeding unit for feeding paper one by one from a paper feeding cassette, and output unit for outputting paper on which an image has been formed by the image forming unit 25 (none of the foregoing is shown in the drawings).

[The Constitution of an Original Document Supply Device]

Figure 3:
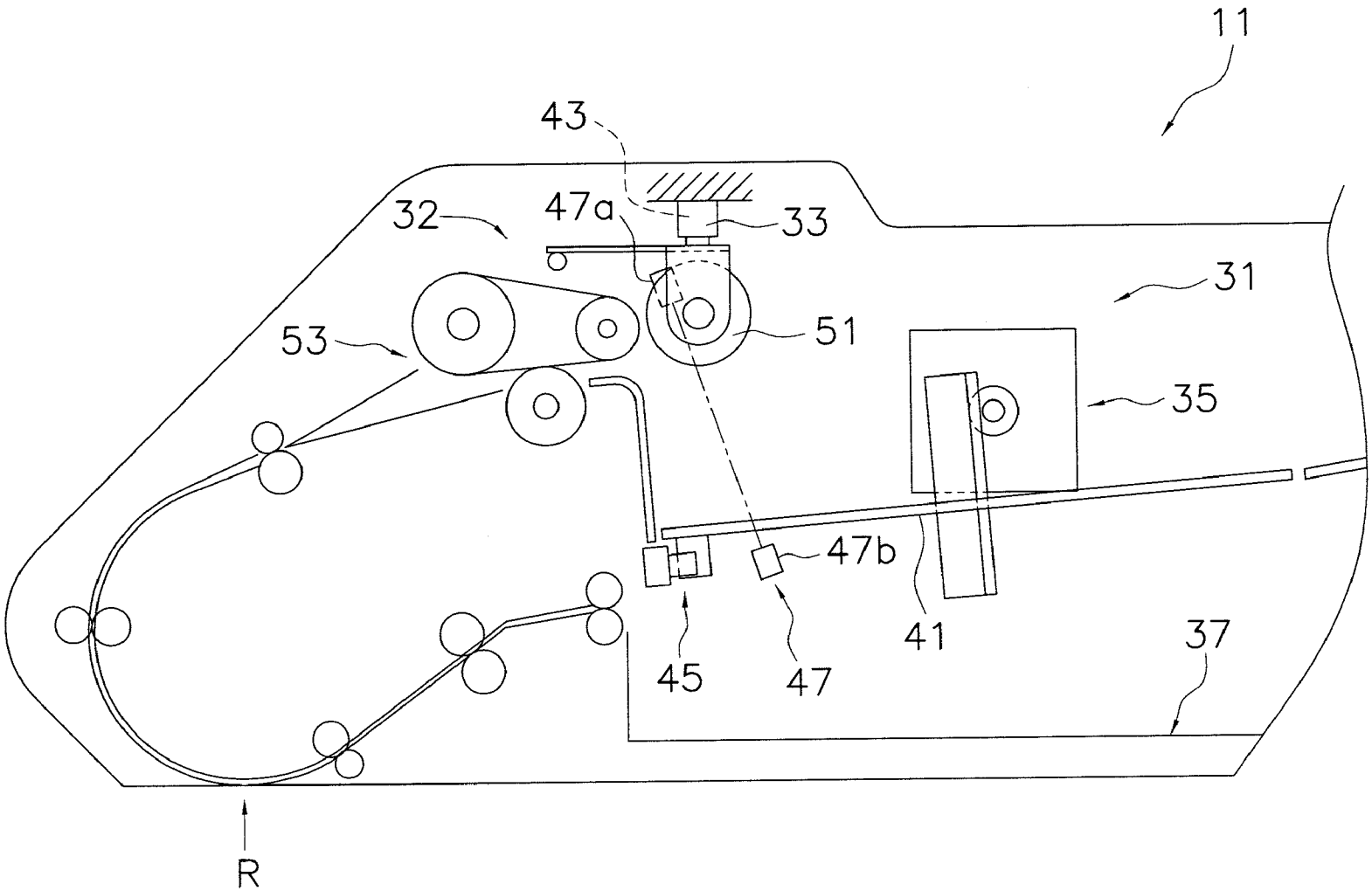
FIG. 3 shows a vertical cross-sectional view of an original document supply device for the image forming device.

As shown in FIGS. 2 and 3, the ADF 11 is a device for feeding the original document toward an original document scanning position R, comprising an original document loading unit 31, paper handling unit 32, pressure sensor (detection means) 33, lift plate drive unit 35 and original document output tray 37.

The original document loading unit 31 has a lift plate 41, upper limit sensor 43, lower limit sensor 45 and original document set detection sensor 47.

The lift plate 41 is a plate-shaped member allowing an original document to be loaded thereupon, and is capable of moving to the upper limit in the paper loading direction by the lift plate drive unit 35.

The upper limit sensor 43 is a sensor for stopping the lifting of the lift plate 41 at a predetermined position, and is constituted by an optical sensor. The upper limit sensor 43 is configured so that when the lift plate 41 is lifted and the paper feeding roller 51 (described below) is pushed up by the original document on the lift plate 41, such action is optically detected and ended.

The lower limit sensor 45 is a sensor for detecting that the lift plate 41 has been lowered to the lowermost position.

The original document set detection sensor 47 is a sensor for detecting that an original document is set on the lift plate 41, comprising a light emitting unit 47*a* and light emitting unit 47*b*; when an original document blocks the light shining therebetween, it is detected that an original document has been set.

The paper handling unit 32 is for feeding an original document on the lift plate 41, and comprises a paper feeding roller (paper feeding unit) 51 and separation roller 53.

The paper feeding roller 51 is disposed with an interval above the lift plate 41 when disposed at the lowermost position, and in a free state is positioned at the lower position from its own weight; in accordance with force received from below from the lift plate 41 it can move upwards. Thus, when the lift plate 41 is in the paper feeding state, the paper feeding roller 51 is in direct contact with the edge of an original document set on the lift plate 41, and when the start button is pressed, the paper feeding roller 51 can feed paper toward the original document scanning position R.

The separation roller 53 is for handling an original document fed from the paper feeding roller 51 to prevent feeding of multiple sheets.

The pressure sensor 33 is capable of detecting the degree of upward pressure on the paper feeding roller 51. Specifically, the pressure sensor 33 is capable of detecting pressure pushing up the paper feeding roller 51 when an additional original document is to be added to the original document on the lift plate 41 in a paper feeding state or when the original document already set on the lift plate 41 is to be reset.

The lift plate drive unit 35 is for causing the lift plate 41 to vertically move, and is constituted by a stepping motor, rack-and-pinion mechanism or the like. The lift plate 41 is controlled by the control unit 27 in various ways. Specifically, the lift plate 41 is promptly lifted upon the setting of an original document on the lift plate 41, and in a paper feeding state, the lift plate 41 is lowered to a degree corresponding to degree of pressure when pressure is detected by the pressure sensor 33. When a predetermined time (for example, about a few seconds) has passed without further detection of pressure in a state where the lift plate 41 has been lowered (stand-by state), the lift plate drive unit 35 causes the lift plate 41 to be lifted.

The original document output tray 37 is a place where the original document scanned by the original document scanning position R is expelled.

[Operation of an Image Forming Device]

Figure 4:
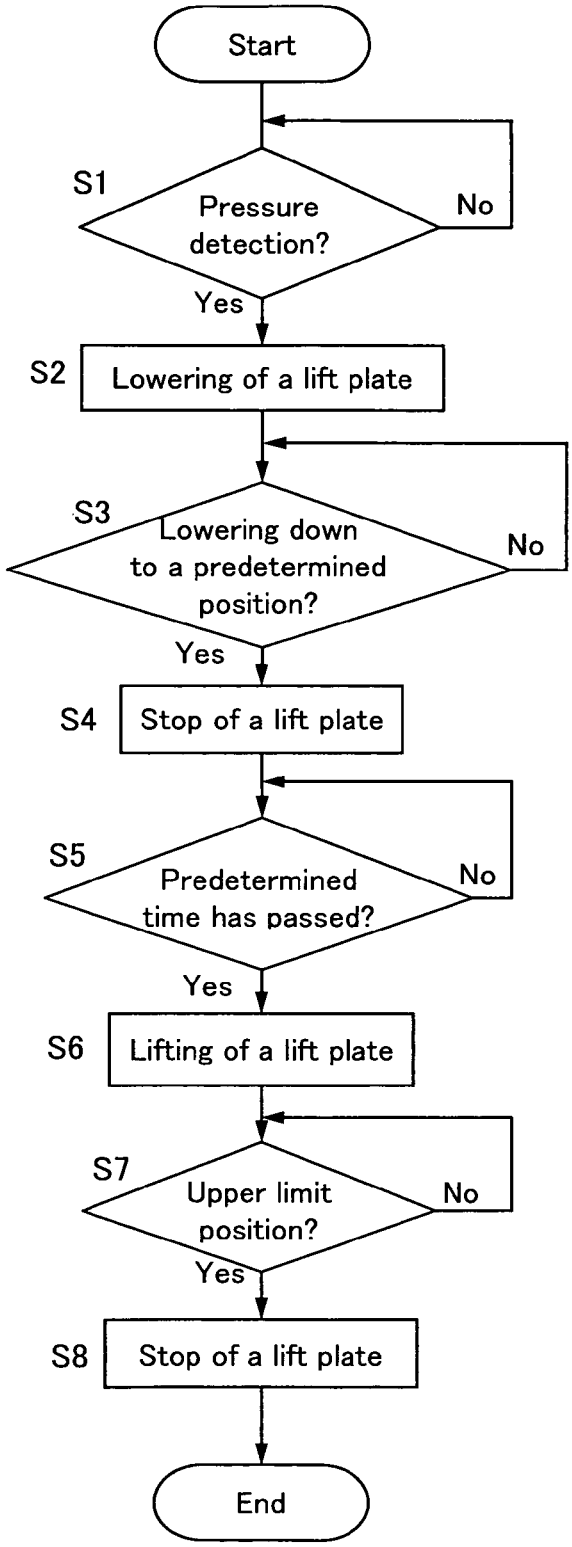
FIG. 4 is a flowchart for explaining the operations of the original document supply device.

Next, an example of the operation of the image forming device 1 will be explained with reference to FIG. 4.

The image forming device 1 is configured such that in a case where the lift plate 41 is in the paper feeding state, for example, when pressure on the paper feeding roller 51 has been detected (Step 1) because an additional original document is to be added to the already set original document on the lift plate 41, the lift plate 41 starts lowering (Step 2), and when the lift plate 41 is lowered to a predetermined position (a lower position in accordance with degree of pressure) to come to a stand-by state (Step 3), the lift plate 41 stops being lowered (Step 4). As a result, a space is formed between the original document and paper feeding roller 51, thereby allowing an original document to be added or reset.

When a predetermined time has passed since the lift plate 41 reached a stand-by state (Step 5), the lift plate 41 is lifted (Step 6), and when the lift plate 41 is lifted to the upper limit position (Step 7), the lifting stops (Step 8).

According to the image forming device 1 thus configured, in a paper feeding state, when pressure has been detected as a separate original document is to be added, the lift plate 41 is lowered, thereby forming a space between the paper feeding roller 51 and the original document. As a result, addition and reset of an original document is facilitated. Therefore, with this device 1, not only is time from printing instruction to printing start shortened, as the same time, when necessary an original document can be added or reset.

[Other Embodiments]

(a) The constitution of the sensors of an ADF is not limited to the above. For example, a lower limit switch may be omitted.

(b) The control unit may be configured so that an instruction system is partly disposed inside an ADF. In this case, a predetermined length of time may be measured by the instruction system inside the ADF.

(c) As an alternative to extent of lowering range in accordance with degree of pressure, lowering of the lift plate may be stopped at a position where, for example, the detected pressure decreases to a certain degree.

(d) The original document supply device of the present invention may be employed in any type of device capable of dual-side scanning comprising a sheet-inversion function.

What is claimed is:

1. An original document supply device for an image forming device to feed an original document toward an original document scanning position comprising:

an original document loading unit having a lift plate allowing the original document to be loaded thereupon and being configured to move vertically in the original document loading direction;

a paper feeding unit disposed above the lift plate disposed at the lowermost position with an interval therebetween and configured to move upwardly following receiving pressure from below by the lift plate;

a pressure sensor detecting a degree of upward pressure on the paper feeding unit; and a lift plate drive unit causing the lift plate to be immediately lowered only to an extent corresponding to the degree of pressure detected by the pressure sensor.

2. An original document supply device for an image forming device according to claim 1, wherein if after detection of the degree of upward pressure on the paper feed unit and the lift plate has been lowered, no further upward pressure is detected after a prescribed time has passed, the lift plate drive unit causes the lift plate to be lifted.

3. An image forming device comprising an original document supply device for an image forming device described in claim 1, and a main unit comprising an original document scanning unit, disposed to face the original document supply device, for scanning image information of the original document and an image forming unit for forming an image according to image information scanned by the original document scanning unit.

* * * * *